US012005291B1

(12) United States Patent
Ross et al.

(10) Patent No.: US 12,005,291 B1
(45) Date of Patent: Jun. 11, 2024

(54) SUSPENDED BODY WEIGHT TRAINER

(71) Applicant: Exemplar Design, LLC, Mason, OH (US)

(72) Inventors: Adam L. Ross, Loveland, OH (US); Mauricio Delgado, South Jordan, UT (US)

(73) Assignee: EXEMPLAR DESIGN, LLC, Mason, OH (US)

( * ) Notice: Subject to any disclaimer, the term of this patent is extended or adjusted under 35 U.S.C. 154(b) by 0 days.

(21) Appl. No.: 18/306,442

(22) Filed: Apr. 25, 2023

Related U.S. Application Data

(60) Provisional application No. 63/492,560, filed on Mar. 28, 2023.

(51) Int. Cl.
*A63B 21/068* (2006.01)
*A63B 21/00* (2006.01)

(52) U.S. Cl.
CPC ..... *A63B 21/068* (2013.01); *A63B 21/4035* (2015.10); *A63B 2208/029* (2013.01); *A63B 2225/093* (2013.01)

(58) Field of Classification Search
CPC ..... A63B 21/068; A63B 21/4035; A63B 2208/029; A63B 2225/093
See application file for complete search history.

(56) References Cited

U.S. PATENT DOCUMENTS 7,044,896 B2 * 5/2006 Hetrick ..... A63B 21/0023 482/141
7,090,622 B2 8/2006 Hetrick
7,651,448 B2 1/2010 Hetrick
7,722,505 B2 5/2010 Liao et al.
7,762,932 B2 * 7/2010 Hetrick ..... A63B 21/4035 482/904
7,785,244 B2 8/2010 Hetrick
7,806,814 B2 10/2010 Hetrick
8,043,197 B2 * 10/2011 Hetrick ..... A63B 21/4043 482/904
8,083,653 B2 12/2011 Hetrick
D669,945 S 10/2012 Russo et al.
8,317,667 B1 * 11/2012 Thomas ..... A63B 21/0421 482/121
8,469,864 B2 6/2013 Hetrick
8,840,532 B2 9/2014 Hetrick et al.
9,155,931 B2 10/2015 Hetrick
9,433,258 B2 * 9/2016 Hetrick ..... A63B 21/4043
D831,764 S 10/2018 Hetrick et al.
(Continued)

*Primary Examiner* — Andrew S Lo
(74) *Attorney, Agent, or Firm* — BakerHostetler

(57) ABSTRACT

The present disclosure relates to a suspended body weight trainer that provides adjustability, is capable of withstanding significant forces, and is robust and resistant to wear and tear. More specifically, the disclosed suspended body weight trainer can be adjustable as to: different strap lengths, so that the grips may be adjusted as desired, based upon user height or exercise being performed; how the grips operate; and the different kinds of grips (or other user-interface devices such as, for example, handles, straps (to create a foot loop), balls, bars etc.) that can be used. In aspects of the disclosure, methods of mounting the straps of the suspended body weight trainer to an anchor providing improved usability and wear resistance thereof are also disclosed.

20 Claims, 8 Drawing Sheets

(56) References Cited

U.S. PATENT DOCUMENTS

D842,946 S 3/2019 Hetrick et al.
10,245,460 B2 4/2019 Hetrick et al.
10,857,413 B2 12/2020 Hetrick et al.
D912,742 S * 3/2021 Qiao ..... A63B 21/154 D21/694
11,400,334 B2 8/2022 Hetrick et al.
2009/0075787 A1* 3/2009 Hetrick ..... A63B 21/068 482/91
2010/0116588 A1* 5/2010 Bamberg ..... A62B 1/14 182/5
2011/0166003 A1* 7/2011 Brice ..... A63B 21/4035 482/131
2012/0035031 A1* 2/2012 Silverman ..... A63B 21/1645 482/139
2012/0277074 A1* 11/2012 Zeldakov ..... A63B 7/02 482/126
2012/0289382 A1* 11/2012 Haddad ..... A63B 21/0004 482/93
2012/0329618 A1* 12/2012 White ..... A63B 21/0552 482/126
2014/0005015 A1* 1/2014 Hester ..... A63B 21/154 482/131
2014/0082891 A1* 3/2014 Hetrick ..... A44B 11/02 24/265 BC
2014/0155233 A1* 6/2014 Latronica ..... A63B 23/1272 482/139
2015/0133277 A1* 5/2015 Alexandrov ..... A63B 21/4035 482/131
2016/0287927 A1* 10/2016 Hunter ..... A63B 21/0552
2017/0014665 A1* 1/2017 Bowles ..... A63B 21/4013
2017/0150786 A1* 6/2017 Ness ..... A63B 21/0552
2017/0157448 A1* 6/2017 Shavell ..... A63B 21/08
2017/0225024 A1* 8/2017 Thrasher-Rudd ..... A63B 21/4035
2018/0140886 A1* 5/2018 Hetrick ..... A63B 21/068
2018/0140894 A1* 5/2018 Ross ..... A63B 21/08
2018/0178050 A1* 6/2018 Prihar ..... A63B 21/4035
2018/0290007 A1* 10/2018 Vorozilchak ..... A63B 21/06
2018/0318631 A1* 11/2018 Siu ..... A63B 21/0442
2019/0091507 A1* 3/2019 Hetrick ..... A63B 21/4043
2019/0217141 A1* 7/2019 Ott ..... A63B 21/4043
2019/0381385 A1* 12/2019 Penn ..... A63B 61/006
2020/0155890 A1* 5/2020 Casagrande ..... A63B 21/0557
2020/0206560 A1* 7/2020 Alexandru ..... A63B 21/1681
2020/0238124 A1* 7/2020 Perez ..... A63B 21/4035
2021/0052933 A1* 2/2021 Hetrick ..... A63B 21/4043
2021/0268327 A1* 9/2021 Kushner ..... A63B 21/018
2021/0353991 A1* 11/2021 Yeates ..... A63B 21/00043
2022/0233914 A1* 7/2022 Birger ..... A63B 23/0488

* cited by examiner

SUSPENDED BODY WEIGHT TRAINER

CROSS REFERENCE TO RELATED APPLICATIONS

The current application claims priority to provisional application No. 63/492,560, filed Mar. 28, 2023; the disclosure of which is incorporated herein by reference.

FIELD OF THE DISCLOSURE

The current disclosure relates to a suspended body weight training device, and more particularly, to a suspended body weight training device having improved adjustability and wear resistance, as well as an improved handle design.

BACKGROUND

Suspended body weight training (also known as suspension training) is a well-known training technique that generally involves a user performing exercise against the weight of his or her body, usually by use of grips which are attached to straps suspending from a wall, ceiling, door frame or other fixed structure. Examples of exercises performed thereby include the user grasping the grips while leaning forwardly or backwardly so that the grips and the connected straps support the user's body. The user may then push or pull on the grips to work against his/her own weight. The user may then perform push-ups or pull ups (or other exercise) against the grips and can manipulate their body to affect the muscles affected and the amount of resistance created by each repetition of the respective exercise. Exercises can also be performed with the feet/legs of the user. The number and type of exercises that can be done, and their effectiveness for the user, can depend on the degree of adjustability that a particular suspended body weight trainer provides. Accordingly, suspended body weight trainers with greater adjustability tend to be more desirable than those with little adjustability.

With respect to adjustability, there are many ways that suspended body weight trainers can be adjustable. They can be adjustable as to different lengths of the straps so that the grips may be adjusted as desired based upon user height or exercise being performed, how the grips operate, and the different kinds of grips (or other user-interface devices such as, for example, handles, straps (to create a foot loop), balls, bars etc.) that can be used. In this regard, if the suspended body weight trainer is one that includes multiple grips/handles/etc. that may be changed, it is helpful if the attachment device for the grips/handles is easy to use, secure when in use, capable of withstanding significant force, and robust from a wear standpoint. Similarly, it is known for suspended body weight trainers of this type, particularly ones that comprise a single strap, or two straps, extending from a single anchor point, that it is desirable that the respective right and left straps of the suspended body weight trainer be easily adjustable by the user so that the trainer provides an equal length of strap webbing extending from each side of the anchor point. And once again, as above, it is desired that the apparatus or device used to provide this operability be easy to use, secure when in use, capable of withstanding significant force, and robust from a wear standpoint.

As noted above, prior suspended body weight trainers have been known with interchangeable grips and, in particular grips that include straps attached thereto that may be used for engagement by a user's foot. In this regard, prior handle/foot loop type grips have had issues with respect to durability and usability. Accordingly, it would be desired to have a hand grip/foot loop attachment for a suspended body weight trainer that provides improvements in durability and usability, and which is easy to use, secure when in use, capable of withstanding significant force, and robust from a wear standpoint.

SUMMARY

In an aspect of the present disclosure, a suspended body weight training device is provided that provides adjustability, is capable of withstanding significant forces, is robust and resistant to wear and tear. More specifically, an aspect of the present disclosure provides a suspended body weight trainer that can be adjustable as to different lengths of the straps so that the grips may be adjusted as desired based upon user height or exercise being performed different. The disclosure also provides a suspended body weight trainer that has different types of grips (or other user-interface devices such as, for example, handles, straps (to create a foot loop), balls, bars etc.) that can be used. In aspects of the disclosure, methods of mounting the straps of the suspended body weight trainer to an anchor via a novel rocking carabiner clip provides improved usability and wear resistance thereof are also disclosed.

In another aspect of the disclosure, a suspended body weight trainer is provided that includes multiple grips/handles/etc. that may be changed in a manner that is easy for a user to do, secure when in use, capable of withstanding significant force, and robust from a wear standpoint. In yet a further aspect of the disclosure, a single anchor point suspended body weight trainer is provided that includes a rocking carabiner clip that automatically adjusts the effective strap lengths to operate at equal length that is, secure when in use, capable of withstanding significant force, and robust from a wear standpoint. In other aspects, single anchor point mechanisms are provided that allows the right and left straps of the suspended body weight trainer to be easily and automatically adjusted by the user so that the trainer provides an equal length of strap webbing extending from each side of the anchor point that is, secure when in use, capable of withstanding significant force, and robust from a wear standpoint.

In another aspect of the disclosure, a suspended body weight trainer is disclosed having interchangeable grips and, in particular at least one set of grips that include straps attached thereto that may be used for engagement in any number of ways including, by way of example, a user's foot. In accordance therewith, the grip/strap combination in accordance with the disclosure may comprise an adjustable strap/loop attached to a hand grip which has a length that is easy to adjust for different uses and/or exercises, which securely maintains that adjustment during use, and which is capable of withstanding significant force, and is robust from a wear standpoint, particularly in the manner the hand-straps are attached to the grip.

The features of a suspended body weight trainer described herein, together with various other ancillary provisions and features thereof, will become apparent to those skilled in the art from the following detailed description, exemplary embodiments thereof being shown with reference to the accompanying drawings provided herewith, by way of example only, and described in brief below.

DETAILED DESCRIPTION

Exemplary embodiments of the present disclosure now will be described more fully hereinafter with reference to the accompanying drawings. This disclosure, may however, be embodied in many different forms and should not be construed as limited to the exemplary embodiments set forth herein.

Figures 1A, 1B, 1C:
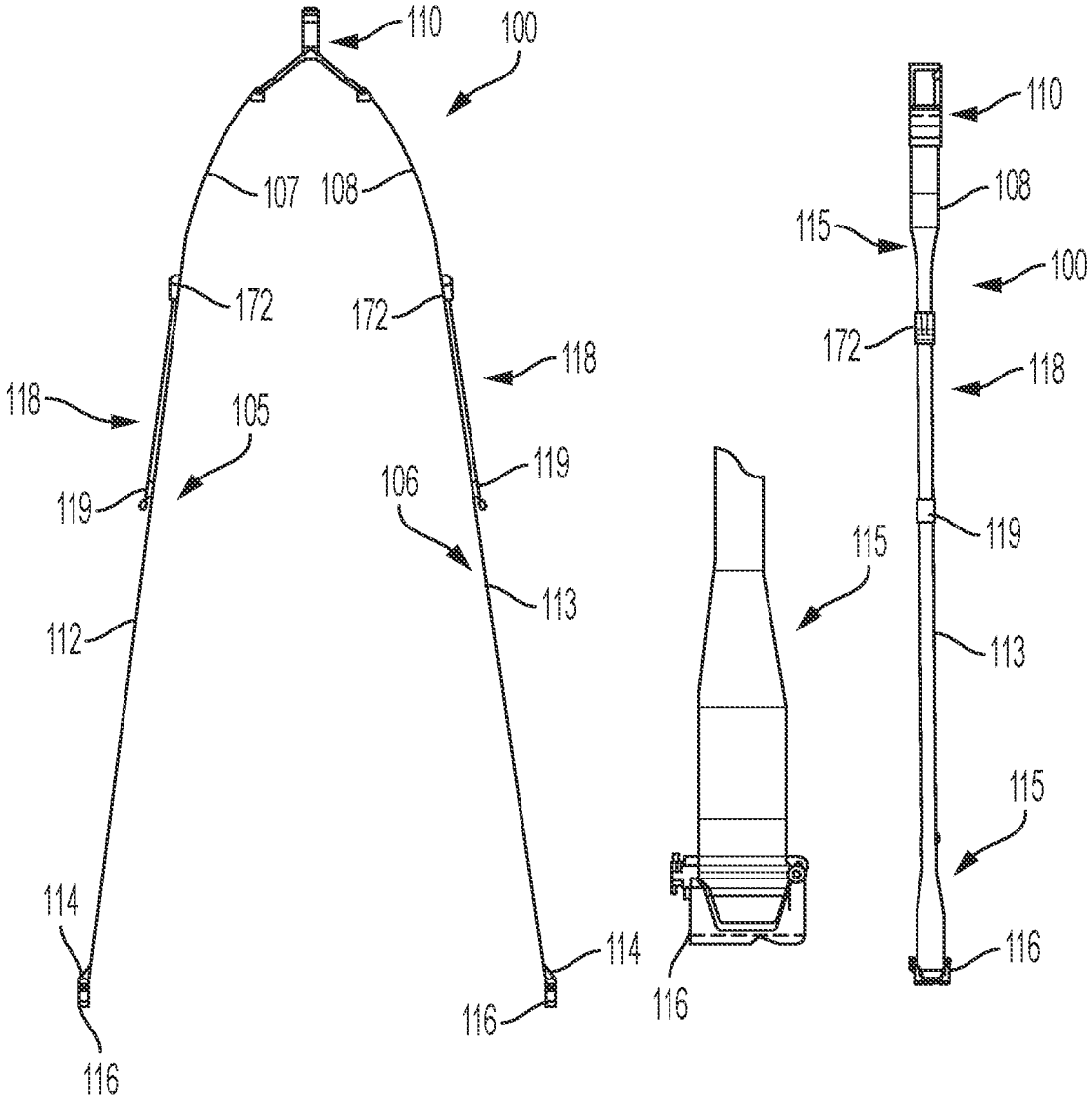
FIG. 1A is a front elevation view of an exemplary suspended body weight trainer according to an aspect of the current disclosure.
FIG. 1B is a front detail partial side elevational view of a tapered strap feature suitable for use with a suspended body weight trainer, such as the suspended body weight trainer shown in FIG. 1, according to an aspect of the current disclosure.
FIG. 1C is a right side elevation view of the suspended body weight trainer of FIG. 1 according to an aspect of the current disclosure.

As shown in FIG. 1A, exemplary embodiments of the present disclosure provide a suspended body weight trainer 100 having various different manners of adjustability to provide the user the ability to perform multiple different exercises as desired, is capable of withstanding significant forces, is robust and resistant to wear and tear.

As shown, for example, in FIGS. 1A-1C, the suspended body weight trainer 100 of the present disclosure, may comprise a rocking anchor clip 110, for anchoring the suspended body weight trainer 100 to a stationary object (not shown) and a pair of strap assemblies 105, 106 attached to and extending from the rocking anchor clip 110. The strap assemblies 105, 106, each include non-adjustable straps 107, 108 attached to and extending from the rocking anchor clip 110 and another pair of length-adjustable straps 112, 113 attached to the non-adjustable straps by adjustor buckles 172 as described below. Adjustable straps 112, 113 extend from the adjustor buckles 172 to a lower terminal point comprising, for example, a loop 114 having an attachment mechanism 116 attached thereto. As is known in the art, the straps 107, 108, 112, 113 (as well as all of the other straps disclosed herein) may be made from conventional materials used for exercise products of this type, and, for example, automobile seat belts. In accordance therewith, while not 100% inelastic (as no fabric material can be), the straps may be mostly inelastic (i.e., substantially inelastic) in accordance with the disclosure. Further, as shown best in FIGS. 1B and 1C, a variable width webbing strap may be used where the strap narrows down at tapered segments 115 from a wider width providing more robust and wear-resistant qualities (at, for example, strap attachment and high stress points) to narrower widths at areas where such strength and robustness is not as critical. This is a way of increasing cost effectiveness without sacrificing usability or durability of the suspended body weight trainer. Solely by way of example, the strap width may narrow from a width of approximately 1.5 inches wide to as low (or even lower) than 0.75 inches wide. Of course, other dimensions/widths differing from this exemplary embodiment are possible and considered within the scope of the present disclosure. As shown in FIGS. 1B and 1C, loose end portions 118 of straps 112, 113 that extend through adjustor buckles 172 may be captured in place by sleeves 119.

Figure 2A:
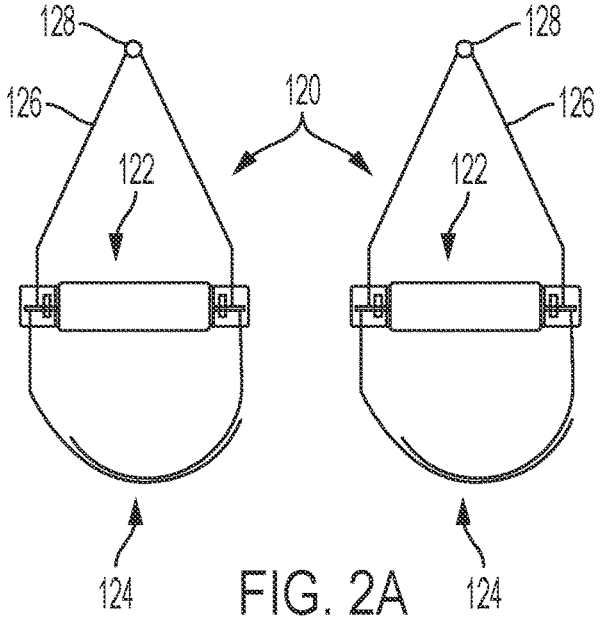
FIG. 2A is a front elevation, partial sectional view of a pair of grip/strap combinations for use with a suspended body weight trainer, such as the suspended body weight trainer of FIG. 1, in accordance with an aspect of the present disclosure.
Figure 2B:
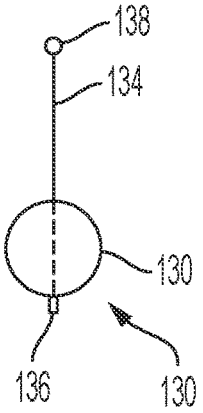
FIG. 2B is a front elevation, partial sectional view of a ball grip for use with a suspended body weight trainer, such as the suspended body weight trainer of FIG. 1, in accordance with an aspect of the present disclosure.
Figure 2C:
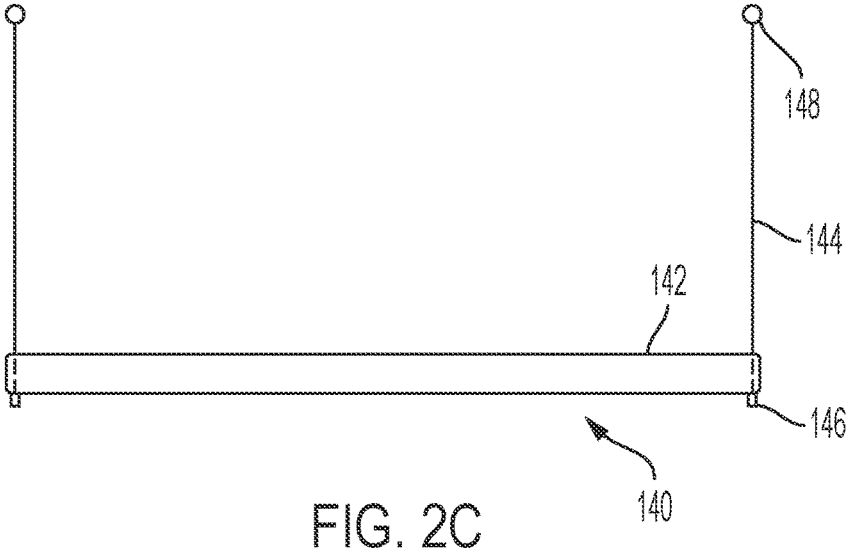
FIG. 2C is a front elevation, partial sectional view of a bar grip for use with a suspended body weight trainer, such as the suspended body weight trainer of FIG. 1, in accordance with an aspect of the present disclosure.
Figure 3A:
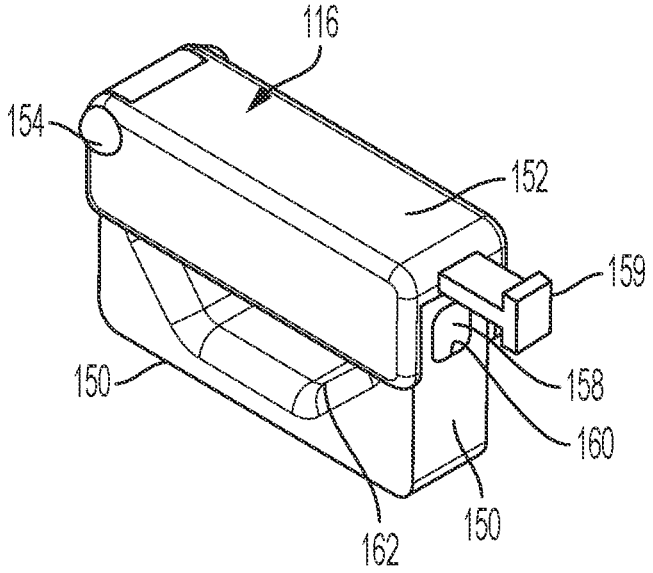
FIG. 3A is a perspective view of an attachment mechanism for use in attaching gripping devices, such as those shown in FIGS. 2A-2C, suitable for use with a suspended body weight trainer, such as the suspended body weight trainer shown in FIG. 1, in accordance with an aspect of the present disclosure.
Figure 3B:
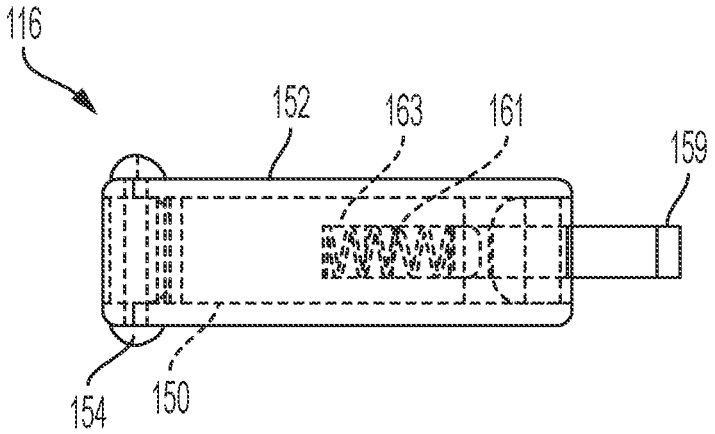
FIG. 3B is a top plan view of the grip attachment mechanism of FIG. 3A (with interior components shown in fantom)
Figure 3C:
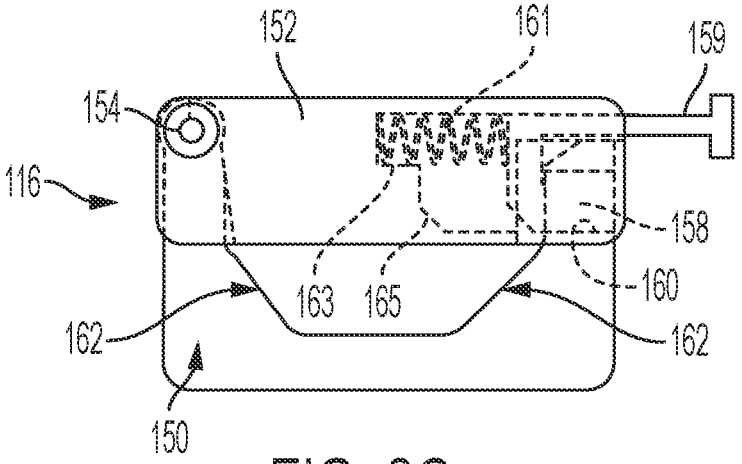
FIG. 3C is a front elevation view of the grip attachment mechanism of FIG. 3A (with interior components shown in fantom)
Figure 3D:
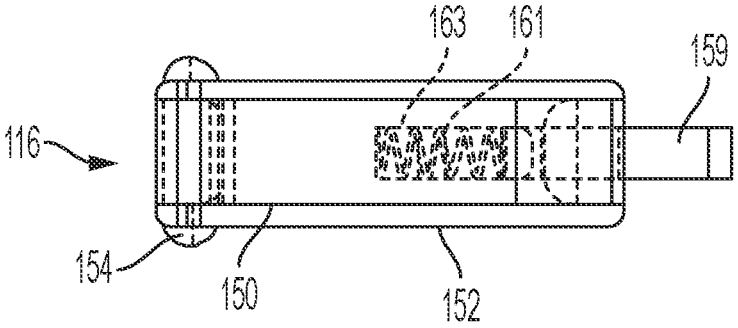
FIG. 3D is a bottom plan view of the grip attachment mechanism of FIG. 3A (with interior components shown in fantom)

Further, as shown best in FIGS. 2A-2C, in an exemplary embodiment of the present disclosure, a variety of hand grips, stirrups, exercise bars, balls, or other interactive devices may be used and/or supplied with the disclosed suspended body weight trainer 100 for a user to grip and perform various different exercises as may be desired. Specifically, as shown in FIG. 2A, a pair of grip/strap combinations 120 may comprise a hand grip 122, a foot strap 124 and an attachment strap 126. The attachment strap 126 may include a fabric loop 128 at a terminus thereof to be used for connecting the grip/strap 120 to the suspended body weight trainer 100 attachment mechanism 116 or may comprise a single loop of continuous webbing (not shown). As shown in FIG. 2B, a pair of ball grips 130 may comprise a ball portion 132, an attachment strap 134, where attachment strap 134 extends through the ball portion 132 and includes a stop 136 on end thereof. The attachment strap 134 may include a fabric loop 138 at a terminus thereof to be used for connecting the ball grips 130 to the suspended body weight trainer 100 attachment mechanism 116 or may comprise a single loop of continuous webbing (not shown). As shown in FIG. 2C, a bar 140 may be comprised of a tube-shaped grip portion 142, an attachment strap 144, where attachment strap 144 extends through the grip portion 142 and includes a stop 146 on end thereof. The attachment strap 144 may include a fabric loop 148 at a terminus thereof to be used for connecting the bar 140 to the suspended body weight trainer 100 attachment mechanism 116 or may comprise a single loop of continuous webbing (not shown).

As shown best in FIGS. 3A-3D, attachment mechanism 116 may comprise a heavy-duty, D-shaped carabiner-type spring-clip. The attachment mechanism 116 may include a lower portion 150 (comprising the curved portion of the D-shape) and an upper retainer portion 152 (comprising the straight portion of the D-shape), the retainer portion 152 being attached to the lower portion 150 by a pivot 154. Upper retainer portion 152 is locked onto the lower portion 150 by a spring-biased bolt 158 slidably mounted for reciprocation within the retainer portion 152, where the bolt 158 extends within a corresponding bolt-channel 160 in the lower portion 150 when locked and slides out of the bolt-channel 160 to unlock (and thus allow the retainer portion 152 to pivot upwardly on pivot 154). The bolt 158 is integrally formed (in this exemplary embodiment) with a push-button 159 that extends in the same direction as the bolt 158 so that the bolt and push-button integral component 158, 159 has a J-shape in a side view (where the push button 159 is provided on the longer vertical extent of the J-shape and the bolt 158 is provided on the shorter vertical extent of the J-shape). Retainer portion 152 includes a spring 161 seated within an aperture 163 where the spring acts against the bottom of the J-shape bolt and push-button integral component 158, 159 so as to bias the bolt 158 into the bolt-channel 160 in the lower portion 150. The retainer portion 152 also includes an internal channel 165 that receives the bolt 158 (and the bottom of the J-shape) to slide therein when a user presses on the push-button 159 (overcoming the spring 161 bias) to slide the bolt 158 out from the bolt-channel 160, thus unlocking the retainer portion 152 from the lower portion 150. In an exemplary embodiment, the lower portion 150 of the attachment mechanism 116 may include rounded or beveled shoulders 162. The shoulders 162 provide stability and decrease wear on the corresponding attachment straps 126, 134, 144, particularly when the attachment straps comprise a continuous loop of webbing material. In exemplary embodiments, the attachment mechanism may be made of high-strength plastics, nylons, or metal, or a combination of these materials (or other materials) as is known in the art.

Figure 4A:
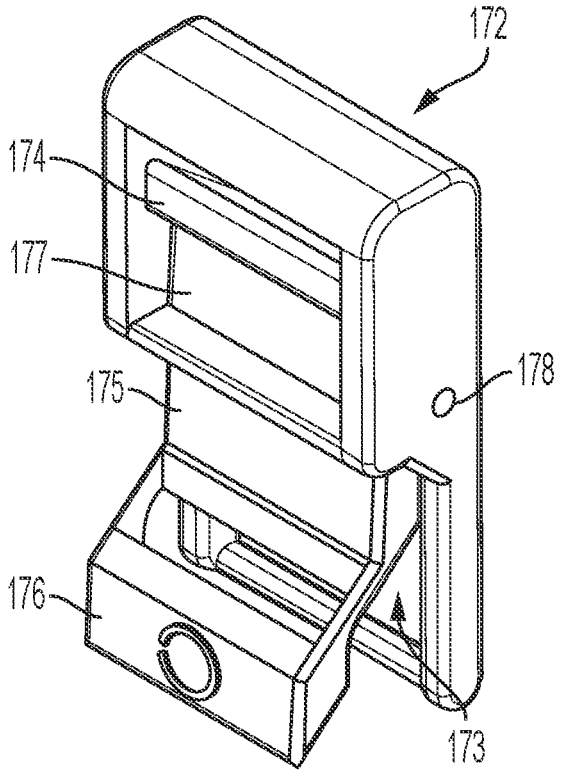
FIG. 4A is a perspective view of a strap adjustment mechanism suitable for use in adjusting the strap length of a suspended body weight trainer, such as the suspended body weight trainer shown in FIG. 1, in accordance with an aspect of the present disclosure.
Figure 4B:
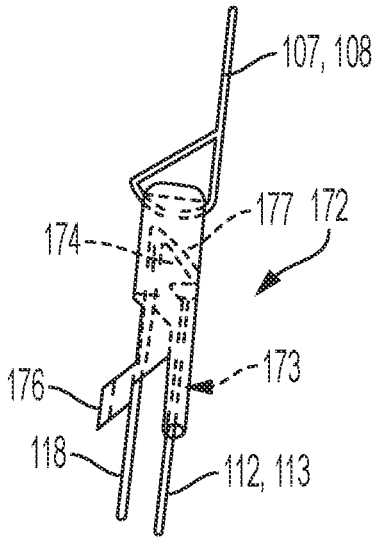
FIG. 4B is a side view of the strap adjustment mechanism of FIG. 4A (with interior components shown in fantom) and also showing straps connected thereto.
Figure 4C:
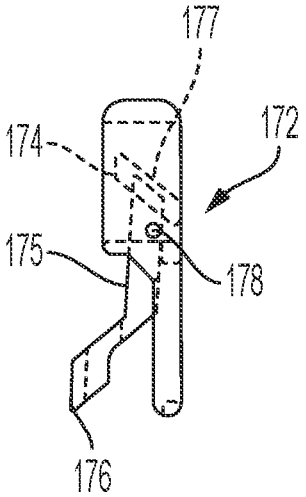
FIG. 4C is a side view of the strap adjustment mechanism of FIG. 4A (with interior components shown in fantom)
Figure 5A:
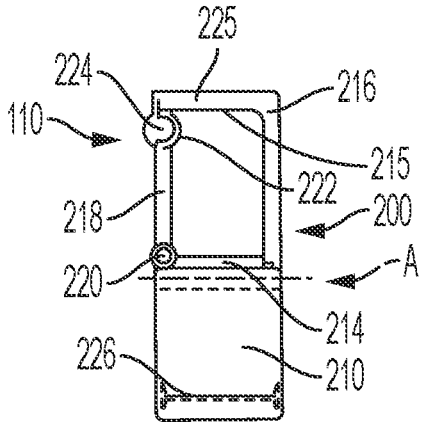
FIG. 5A is a sectional right side elevation view of a rocking anchor clip for use in anchoring the straps of a suspended body weight trainer, such as the suspended body weight trainer shown in FIG. 1, in accordance with an aspect of the present disclosure.
Figure 5B:
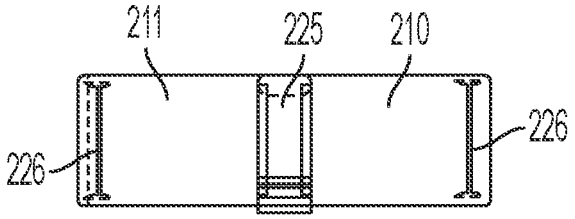
FIG. 5B is a sectional top plan view of the rocking anchor clip of FIG. 5A.
Figure 5C:
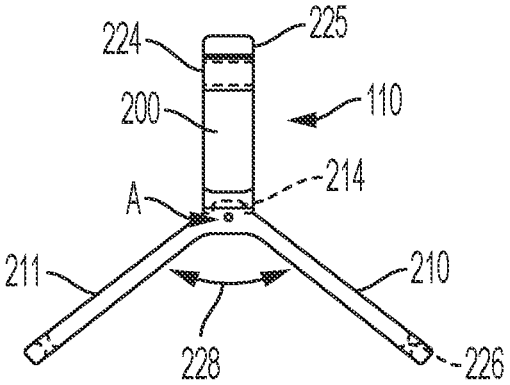
FIG. 5C is a sectional front side elevation view of the rocking anchor clip of FIG. 5A.
Figure 5D:
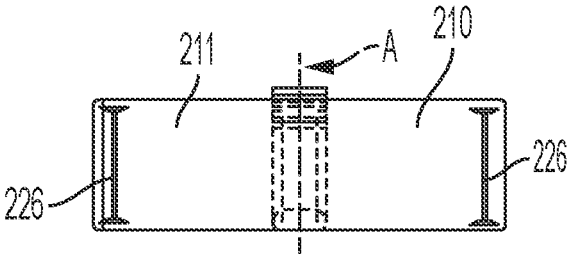
FIG. 5D is a sectional bottom plan view of the rocking anchor clip of FIG. 5A.

As shown best in FIGS. 1A, 1C and 4A, in an exemplary embodiment of the present disclosure, the suspended body weight trainer 100 may be equipped with a manner of adjusting the length of the suspended body weight trainer 100 straps 112, 113 through an through adjustor buckles 172. There are multiple ways of achieving this functionality as is known in the art, but in an exemplary embodiment of the present disclosure, it may be accomplished using adjustor buckles 172 as shown in FIGS. 4A-4C. Each adjustor buckle 172 includes a channel 173 extending into the bottom of the buckle for receiving the strap 112, 113 therein, and an angled pinch surface 174 therein about which the strap is routed around and out again through the bottom of the buckle 172 leaving a free end 118 of the straps 112, 113. Each adjustor buckle 172 further includes an actuatable lever 175 pivotally coupled to the buckle 172 having an actuating end 176, a strap engaging end 177 and a pivot 178 between the actuating and engaging ends. Lever 175 is biased by a torsion spring (not shown) to a closed position as shown in FIGS. 4A-4C, where the engaging end 177 presses the straps 112, 113 against the pinch surface 174, substantially prohibiting the straps 112, 113 from sliding through the buckle (thereby locking length adjustment of the straps 112, 113). To allow for length adjustment of the straps 112, 113, the user presses on the actuating end 176 of the buckle 172 to overcome the bias and pivot the engaging end 177 away from the pinch surface 174, thereby releasing the straps 112, 113 for slidable adjustment through the buckle.

As shown best in FIG. 1A and FIGS. 5A-5D, in accordance with an exemplary embodiment of the present disclosure, a rocking anchor clip 110 for the suspended body weight trainer 100 is disclosed which easily adjusts the lengths, or effective lengths, of the straps 107, 108 when the suspended body weight trainer is being used by a user in order to provide equal forces on both sides of the straps 107, 108. In accordance with one aspect of the disclosure, as shown in FIGS. 5A-5D, this may be accomplished through the use of a rocking anchor clip 110 comprised of a carabiner-type anchor clip 200 having two rocker arms 210, 211 extending therefrom at a downward angle, thereby forming an upside-down Y-shaped rocker mechanism (see FIG. 5C). The carabiner clip 200 may be in the form of a carabiner clip with rocker arms 210, 211 extending downward therefrom at an angle (the rocker arms 210, 211 providing a downward V-shape from the bottom 214 of clip 200 portion). The carabiner clip 200 includes a base 214, a vertical side portion 216 extending up from the base 214, a horizontal support arm 225 extending from a top of side portion 216, and a retainer portion 218 pivotally attached to base 214 by a pivot 220 and preferably including an internal spring (not shown) therein such that the retainer portion 218 is biased in a normally-closed position in a manner known in the art. The retainer portion 218 may include a catch 222 on upper end thereof shaped to receive a corresponding boss 224 extending down from the support arm 225. The clip 200 may thus be used to anchor the suspended body weight trainer 100 to a wall, door frame, ceiling, hook, loop or other stationary object. Arms 210, 211 extend laterally and at a downward angle with respect to an axis A running through base 214 that is parallel to longitudinal axis of horizontal support arm 225. The arms 210, 211 preferably are formed from a strong and durable material (such as metal) and are preferably formed integral with each other and with the bottom 214 and side portion 216 of the clip 200 for strength and durability. The arms 210, 211 and may be formed with an angle 228 between them of about 120° and may include attachment slots 226 formed at their distal ends for receiving the upper ends of the straps 107, 108 therethrough, for example by a loop of webbing. When clipped to a structure or some other stationary object, the rocking anchor clip 110 will pivot about inner stationary surface 215 of upper support arm 225 bridging between side portion 216 and boss 224. The use of the rocking pivot provided by the rocking anchor clip 110 acts to equalize the tension on either side of the straps 112, 113 by rocking and raising one arm 210 while lowering the other 211 thereby equalizing the distance between the handle anchor point 128 and the attachments 226 of straps 107, 108 on both sides. This feature also avoids issues with prior art suspended body weight trainers where the straps would be subjected to friction by "sawing" action through a simple loop or carabiner type anchor. The rocking pivot provided by rocking anchor clip 110 also allows a user to quickly and easily switch from two hand to one hand exercises. Angle 228 between rocker arms 210, 211 may alternatively be between 90° and 150°; although having an even smaller or larger angle for angle 228 will not take it out of the scope of the disclosure. Likewise, rather than having a downward V-shape configuration for the rocker arms 210, 210 alternate configurations are within the scope of the disclosure, such as an upward V-shape configuration or even a t-shape configuration (where angle 228 is 180°).

Figure 6A:
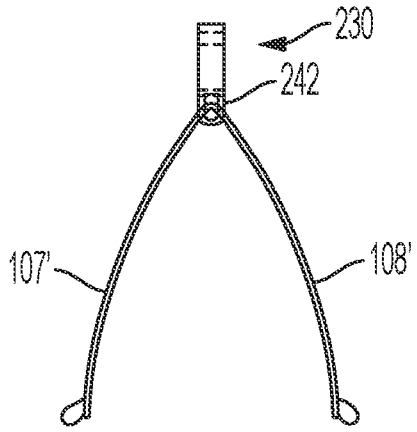
FIG. 6A is a sectional right side elevation view of an alternate strap anchor for use in anchoring the straps of a suspended body weight trainer, such as the suspended body weight trainer shown in FIG. 1, in accordance with an aspect of the present disclosure.
Figure 6B:
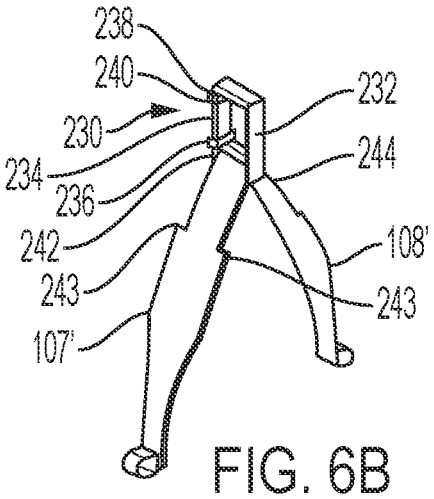
FIG. 6B is a perspective view of the strap anchor of FIG. 6A.
Figure 6C:
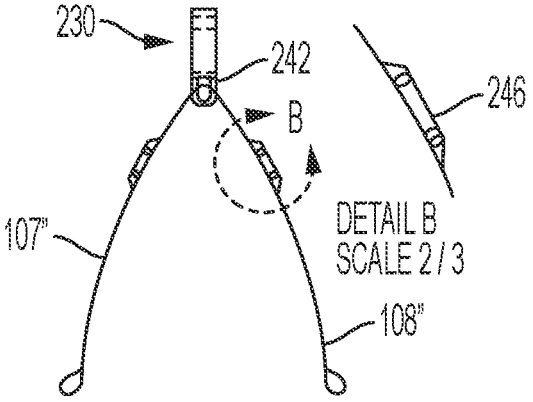
FIG. 6C is a sectional right side elevation view of another alternate strap anchor for use in anchoring the straps of a suspended body weight trainer, such as the suspended body weight trainer shown in FIG. 1, in accordance with an aspect of the present disclosure.
Figure 6D:
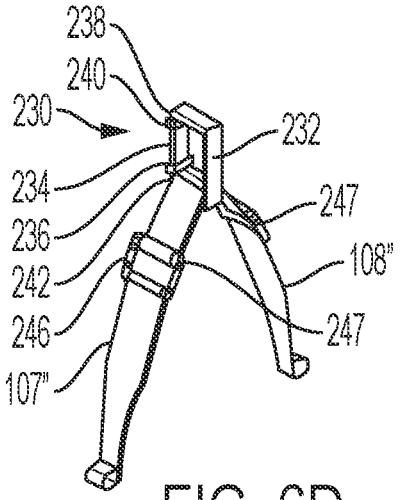
FIG. 6D is a perspective view of the strap anchor of FIG. 6C.

FIGS. 6A-6C depict alternative embodiments of mechanisms for anchoring a suspended body weight trainer 100 in accordance with the present disclosure. Specifically, in these alternate embodiments, a carabiner-type anchor 230 may be utilized. Specifically, the anchor 230 may include a side portion 232 and a retainer portion 234, the retainer portion 234 being attached to the side portion 232 by a pivot 236 and preferably including an internal spring (not shown) therein such that the retainer portion 234 is biased in a normally-closed position in a manner known in the art. The retainer portion 234 may include a catch 238 on end thereof shaped to receive a corresponding boss 240 on the side portion 232. The anchor 230 may thus be used to anchor the suspended body weight trainer 100 to a wall, door frame, ceiling, or other stationary object. The anchor 230 further comprises a ring 242 on the bottom thereof shaped to provide a slot for receiving a length of strap 107, 108 webbing therethrough. As shown in FIG. 6B, the strap 107', 108' webbing (formed from the same webbing) has a width that is wider than the width of the loop 242 but narrows abruptly to a smaller width proximate a center portion of the straps 107', 108' thereby creating stops 243, or shoulders. The narrow width portion 244 of the straps 107', 108' allows the user some adjustability of the length of the straps 107', 108' when in use while the stops 243 prevent too much change and/or more adjustability than is desired as they abut against the ring 242 when the user attempts to pull the straps 107', 108' too far. As shown in FIGS. 6C-6D, an alternate method of providing strap adjustability in a similar manner as set forth above comprises attaching portions of straps 107", 108" to a loop 246, preferably made of metal (or a similar hard and robust material), having a width that is wider than the anchor 230 ring 242. As above, the width of the loop 246 creates stops 247 that abut against the ring 242 thereby allowing some adjustability of the length of the straps 107", 108" while preventing too much change and/or more adjustability than is desired. Other methods of providing similar functionality includes attaching a heavy material (such as plastic or nylon, not shown) to the faces of the straps 107, 108 at desired intervals on either side of the anchor 230 ring 242 to increase the height thereof to greater than the height of the ring 242 thereby allowing some adjustability of the length of the straps 107, 108 while preventing too much change and/or more adjustability than is desired.

Figure 7A:
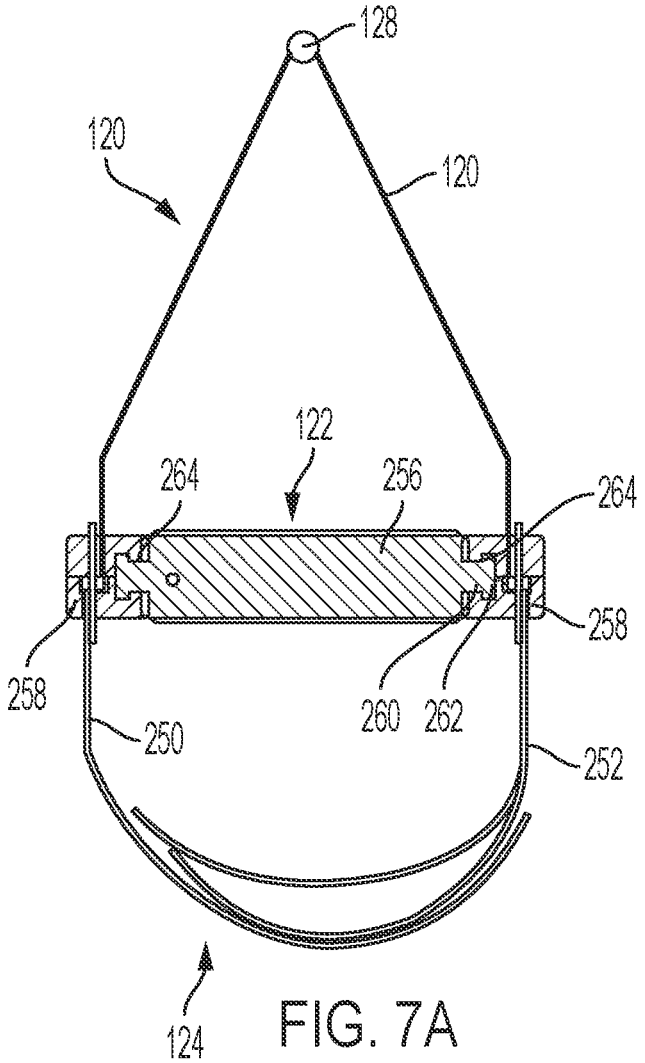
FIG. 7A is a sectional front elevation view of the grip/strap combination shown in FIG. 2A.
Figure 7B:
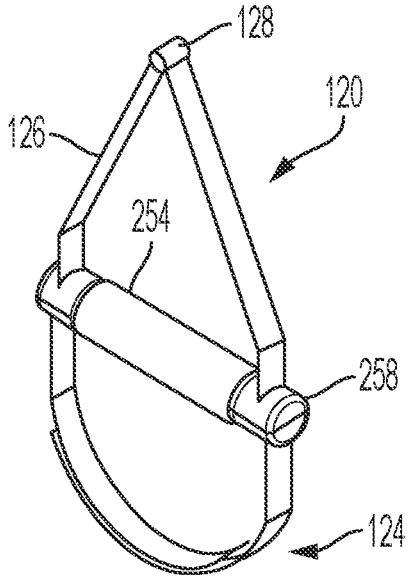
FIG. 7B is a perspective view of the grip/strap combination shown in FIG. 7A.
Figure 7C:
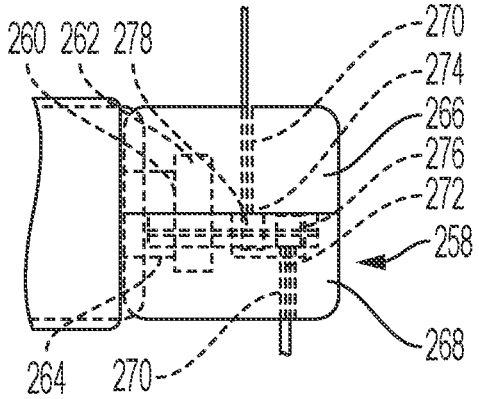
FIG. 7C is a detail sectional view of the strap to grip connection portion of the grip/strap combination shown in FIG. 7A.

As best shown in FIGS. 7A-7C, in accordance with the present disclosure, a grip/strap combination 120 is disclosed. In accordance with the disclosure, the grip/strap combination 120 may be comprised of a hand grip 122, a foot strap 124, and an attachment strap 126. The foot strap 124 may be comprised of two separate straps 250, 252 in order to provide adjustability to the strap 124 through the use of, for example, hook-and-loop fastener strips being attached to the end portions thereof. Other methods of providing adjustability to the strap 124 include, but are not limited to, adjustable buckles, snap-together clips, etc. as is known is the art. The hand grip 122 may include a rubber or foam material 254 attached thereto to make gripping by the user easier and more comfortable. In order to provide increased utility to the user, the hand grip 122 may include a rotating portion 256. More specifically, as best shown in FIGS. 7A and 7C, the hand grip 122 may include end caps 258 shaped to rotatably receive the rotating portion 256. The rotating portion 256 may include bearing nubs 260 having flanges 262 thereon shaped to be received in a corresponding bearing recesses 264 in the end caps 258. The end caps 258 may include an upper portion 266 and a lower portion 268 having slots 270 therein shaped to securingly receive and retain the ends 272 of the strap 124 and the ends 274 of attachment strap 126. In an embodiment of the disclosure, this retention may be accomplished by utilizing stops 276, 278 (which may simply comprise the ends of the straps 124, 126 being doubled on themselves and sewn or otherwise thickened) on the ends of the respective straps 124, 126 so that once the upper portions 266 and lower portions 268 are joined, the straps 124, 126 are securely retained.

Having described exemplary embodiments for a suspended body weight trainer herein, it is noted that modifications and variations can be made by persons skilled in the art in light of the above teachings. It is therefore to be understood that changes may be made in exemplary embodiments of the invention, which are within the scope and spirit of the invention as defined by the appended claims. Having thus described the invention with the details and particularity required by the patent laws, what is claimed and protected is set forth in the appended claims.

What is claimed is:

1. A suspended body weight trainer comprising:

a rocking anchor clip configured to be coupled to a stationary object, the rocking anchor clip including a pair of rocker arms extending therefrom;

a pair of adjustable strap assemblies respectively attached or attachable at an upper end thereof to the pair of rocker arms; and a pair of attachment clips respectively attached or attachable to lower ends of the adjustable strap assemblies, the attachment clips being configured to be attached to a variety of hand grips, stirrups, exercise bars, and/or ball grips.

2. The suspended body weight trainer of claim 1, wherein the rocking anchor clip includes:

a carabiner portion; and the pair of rocker arms extending from the carabiner portion.

3. The suspended body weight trainer of claim 2, wherein the pair of rocker arms extend from the carabiner portion at an angle in a V-shape.

4. The suspended body weight trainer of claim 3, wherein an angle between the pair of rocker arms is between 90° and 150°.

5. The suspended body weight trainer of claim 4, wherein the angle between the pair of rocker arms is about 120°.

6. The suspended body weight trainer of claim 2, wherein each of the pair of rocker arms include a slot approximate an end distal from the carabiner sized to receive a width of a strap from a respective one of the pair of adjustable strap assemblies.

7. The suspended body weight trainer of claim 1, wherein each of the pair of adjustable strap assemblies include:

a stationary strap connected at an upper end to and extending from a respective one of the rocker arms;

a buckle attached to a lower end of the stationary strap; and an adjustable strap adjustably connected at an upper end to the buckle and attached or attachable at a lower end to a respective one of the pair of attachment clips.

8. The suspended body weight trainer of claim 7, wherein the stationary strap includes a first portion approximate the respective one of the rocker arms and a second portion distal from the respective one of the rocker arms, the first portion being wider than the second portion.

9. The suspended body weight trainer of claim 7, wherein the adjustable strap includes a first portion approximate the respective one of the pair of attachment clips and a second portion distal from the respective one of the pair of attachment clips, the first portion being wider than the second portion.

10. The suspended body weight trainer of claim 7, wherein each buckle includes:

a buckle housing having path for receiving the adjustable strap therethrough, the path including a pinch surface; and a lever pivotally coupled to the buckle housing and having an engaging end and an actuating end, the engaging end being biased against the pinch surface, wherein actuation of the actuating end overcomes the bias and releases the engaging end from the pinch surface.

11. The suspended body weight trainer of claim 1, wherein each of the pair of attachment clips include a D-shaped clip having a straight portion of the D-shaped clip pivotally coupled to a first end of the straight portion to a first end of a curved portion of the D-shaped clip, and releasably connectable by an actuatable release at a second end of the straight portion to a second end of the curved portion of the D-shaped clip.

12. The suspended body weight trainer of claim 11, wherein the actuatable release includes:

a reciprocating bolt provided on one of the curved or straight portions of the D-shaped clip and biased into a bolt-channel extending into the other one of the curved or straight portions; and a push button coupled to the bolt, wherein actuation of the push button overcomes the bias and reciprocates the bolt from the bolt-channel.

13. A suspended body weight trainer comprising:

a rocking anchor clip configured to be coupled to a stationary object, the rocking anchor clip including a carabiner portion and a pair of rocker arms extending from the carabiner portion;

a pair of adjustable strap assemblies respectively attached or attachable at an upper end thereof to the pair of rocker arms; and at least one of (a) a pair of hand grips, (b) a pair of stirrups, (c) an exercise bar or (d) a ball grip releasably attached or attachable to respective lower ends of the adjustable strap assemblies;

wherein the pair of rocker arms extend from the carabiner portion at an angle in a V-shape.

14. The suspended body weight trainer of claim 13, wherein an angle between the pair of rocker arms is between 90° and 150°.

15. The suspended body weight trainer of claim 14, wherein the angle between the pair of rocker arms is about 120°.

16. The suspended body weight trainer of claim 13, wherein each of the pair of rocker arms include a slot approximate an end distal from the carabiner sized to receive a width of a strap from a respective one of the pair of adjustable strap assemblies.

17. The suspended body weight trainer of claim 13, wherein each of the pair of adjustable strap assemblies include:

a stationary strap connected at an upper end to and extending from a respective one of the rocker arms;

a buckle attached to a lower end of the stationary strap; and an adjustable strap adjustably connected at an upper end to the buckle and attached or attachable at a lower end to an attachment clip.

18. The suspended body weight trainer of claim 17, wherein the stationary strap includes a first portion approximate the respective one of the rocker arms and a second portion distal from the respective one of the rocker arms, the first portion being wider than the second portion.

19. The suspended body weight trainer of claim 17, wherein the adjustable strap includes a first portion approximate the attachment clip and a second portion distal from the attachment clip, the first portion being wider than the second portion.

20. The suspended body weight trainer of claim 17, wherein each buckle includes:

a buckle housing having path for receiving the adjustable strap therethrough, the path including a pinch surface; and a lever pivotally coupled to the buckle housing and having an engaging end and an actuating end, the engaging end being biased against the pinch surface, wherein actuation of the actuating end overcomes the bias and releases the engaging end from the pinch surface.

* * * * *